US009051105B2

(12) United States Patent
Murray

(10) Patent No.: US 9,051,105 B2
(45) Date of Patent: Jun. 9, 2015

(54) FLEXIBLE POUCH

(75) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 95 days.

(21) Appl. No.: 13/548,881

(22) Filed: Jul. 13, 2012

(65) Prior Publication Data

US 2013/0016925 A1 Jan. 17, 2013

Related U.S. Application Data

(60) Provisional application No. 61/507,338, filed on Jul. 13, 2011.

(51) Int. Cl.

| | |
|---|---|
| ***B65D 33/06*** | (2006.01) |
| ***B65D 33/10*** | (2006.01) |
| ***B65D 30/08*** | (2006.01) |
| ***B65D 30/00*** | (2006.01) |
| ***B65D 75/58*** | (2006.01) |
| ***B31B 1/00*** | (2006.01) |
| ***B65B 43/46*** | (2006.01) |
| ***B65D 75/52*** | (2006.01) |
| ***B65B 7/28*** | (2006.01) |

(52) U.S. Cl.

CPC ..... *B65D 75/5883* (2013.01); *B31B 1/00* (2013.01); *B65B 43/465* (2013.01); *B65D 75/52* (2013.01); *B65B 7/28* (2013.01); *B31B 2219/6038* (2013.01); *B31B 2221/00* (2013.01)

(58) Field of Classification Search

CPC ..... B65D 75/008
USPC ..... 383/109, 6, 7, 10, 16, 21, 116, 107, 907
See application file for complete search history.

(56) References Cited

U.S. PATENT DOCUMENTS

| | | | | |
|---|---|---|---|---|
| 6,199,601 | B1 | 3/2001 | Laudenberg | |
| D493,071 | S * | 7/2004 | Fasula et al. | D7/606 |
| D550,100 | S * | 9/2007 | Soderstrom et al. | D9/699 |
| D550,567 | S * | 9/2007 | Soderstrom et al. | D9/699 |
| D551,089 | S * | 9/2007 | Soderstrom et al. | D9/699 |
| D600,568 | S * | 9/2009 | Murray | D9/708 |
| D619,898 | S * | 7/2010 | Graham et al. | D9/540 |
| 7,828,355 | B2 * | 11/2010 | Kohn et al. | 294/152 |
| D628,902 | S * | 12/2010 | Schroeder et al. | D9/710 |
| 2004/0218839 | A1 * | 11/2004 | Olin | 383/204 |
| 2006/0257057 | A1 * | 11/2006 | Andersen | 383/104 |
| 2007/0211967 | A1 * | 9/2007 | Murray | 383/38 |
| 2008/0247682 | A1 | 10/2008 | Murray | |

(Continued)

FOREIGN PATENT DOCUMENTS

| | | | |
|---|---|---|---|
| WO | 2011032162 | A2 | 3/2011 |
| WO | 2011156575 | A2 | 12/2011 |

*Primary Examiner* — Jes F Pascua
*Assistant Examiner* — Derek Battisti
(74) *Attorney, Agent, or Firm* — Gifford, Krass, Sprinkle, Anderson & Citkowski, P.C.

(57) ABSTRACT

A pouch and method of forming a pouch made of a laminate material is provided. The pouch includes a contoured side edge having crests and troughs in series with each other, the crests are spaced apart from each other so as to form troughs configured to receive the fingers of a user to facilitate the gripping of the pouch. The contours are further operable to prevent the formation of wrinkles along the edges of the pouch body. A method for forming a pouch and operable to prevent ketones from entering the pouch body is also provided.

2 Claims, 5 Drawing Sheets

(56) References Cited

U.S. PATENT DOCUMENTS

| | | | | |
|---|---|---|---|---|
| 2008/0276645 | A1 | 11/2008 | Murray | |
| 2009/0022433 | A1 * | 1/2009 | Goglio et al. | 383/104 |
| 2009/0028470 | A1 * | 1/2009 | Murray | 383/80 |
| 2009/0056281 | A1 | 3/2009 | Murray | |
| 2010/0170591 | A1 | 7/2010 | Murray | |
| 2010/0281822 | A1 | 11/2010 | Murray | |
| 2010/0296754 | A1 * | 11/2010 | Chiu | 383/10 |
| 2011/0061222 | A1 | 3/2011 | Murray | |
| 2011/0108572 | A1 | 5/2011 | Murray | |
| 2011/0218088 | A1 | 9/2011 | Murray | |
| 2012/0008884 | A1 | 1/2012 | Murray | |
| 2012/0210675 | A1 | 8/2012 | Murray | |
| 2012/0289389 | A1 | 11/2012 | Murray | |
| 2012/0289391 | A1 | 11/2012 | Murray | |
| 2013/0001252 | A1 | 1/2013 | Murray | |
| 2013/0015091 | A1 | 1/2013 | Murray | |
| 2013/0016925 | A1 | 1/2013 | Murray | |

* cited by examiner

Method for Manufacturing a Pouch

FLEXIBLE POUCH

CROSS-REFERENCE TO RELATED APPLICATIONS

This Application claims the benefit of U.S. Provisional Application 61/507,338 filed on Jul. 13, 2011, the contents of which is incorporated herein in its entirety.

FIELD OF THE INVENTION

The invention relates to a flexible pouch. More particularly the invention relates to a flexible pouch having a side edge with a contoured peripheral edge extending along a portion thereof. The contoured peripheral edge is operable to assist in the handling of the pouch and to prevent deformation of the outer surface of the pouch during and after filling operations.

BACKGROUND OF THE INVENTION

Flexible pouches are formed from sheets of pliable material such as metal laminates. The sheets may be folded together and the edges sealed so as to form a pouch body. A fitment may be sealed to the pouch body. The fitment includes an opening for providing access to the contents of the pouch. Such pouches are mass produced and filled for commercial use.

In certain instances filling operations create a pressure on the sealed side of the pouch, in particular the inner edge of the seal begins to separate. The separation may result in deformation of the outer surface of the pouch body, causing the appearance of wrinkles as shown in the prior art figure. Furthermore, the fold also forms wrinkles, as shown in the prior art of FIG. 1. Such an imperfection may in turn reduce the commercial desirability of the manufactured pouch. Accordingly, it remains desirable to have a pouch configured to store products wherein the outer surface of the pouch does not form wrinkles during and after filling operations.

Furthermore, in pouch forming operations the outer edge seal may form a generally sharp edge. The sharp edge may cause discomfort to users. Accordingly, it remains desirable to have an outer edge conforming to the grip of a user, and minimizing the effect of the edge so as to facilitate and ease the handling of the pouch.

The pouch is typically formed by sealing the side edges of a sheet of material together to form a pouch body. The side edges are sealed together by melting the side edges to form a unitary sheet of material. However, melting laminate material together in such a manner creates ketones which when introduced into the pouch body may reduce the shelf life of the product or add an unwanted odor. Accordingly, it remains desirable to block the ketones from entering into the pouch body.

SUMMARY OF THE INVENTION

According to one aspect of the invention, a flexible pouch is provided having a peripheral side edge that is contoured. The contoured side edge is operable to prevent the formation of wrinkles along the outer surface of the pouch body during and after filling operations. The pouch body is formed from a sheet of laminate material and folded so as to form the pouch body. A fitment may be added to an opening along the pouch body. A peripheral side edge is sealed and shaped so as to form a plurality of contours extending axially along the side edge. The contours further facilitate the manipulation of the bag by a user. In particular, the contours are configured to fittingly receive the fingers of a user so as to facilitate gripping the pouch body and minimize the tactile effect of an axial side edge of the prior art.

A method of forming a pouch is also provided herein. The method includes the step of providing a first seal to opposing side edges of a sheet of laminate material to form a pouch body. The first seal utilizes a first temperature to melt the surfaces of each of opposing side edges, the melted side edges pressed against each other so as to hold the opposing side edges of the pouch in a fixed position with respect to each other. It should be appreciated that the first temperature is not sufficient to melt the laminate material to the point where ketones are released. Further, only the respective inner surfaces of the side edges are melted. The method proceeds to applying a second seal, the second seal is provided at a temperature greater than the first temperature. The second seal has an outer seal edge disposed between the side edges of the pouch and the outer edge of the first seal. The second seal is configured to transform the melted edges into a solid and unitary piece. Thus, ketones are released during application of the second seal; however, the remaining portion of the first seal forms a barrier preventing the ketones from entering into the pouch body.

BRIEF DESCRIPTION OF THE DRAWINGS

Advantages of the present invention will be readily appreciated as the same becomes better understood by reference to the following detailed description when considered in connection with the accompany drawings wherein.

DETAILED DESCRIPTION OF THE INVENTION

Figure 2:
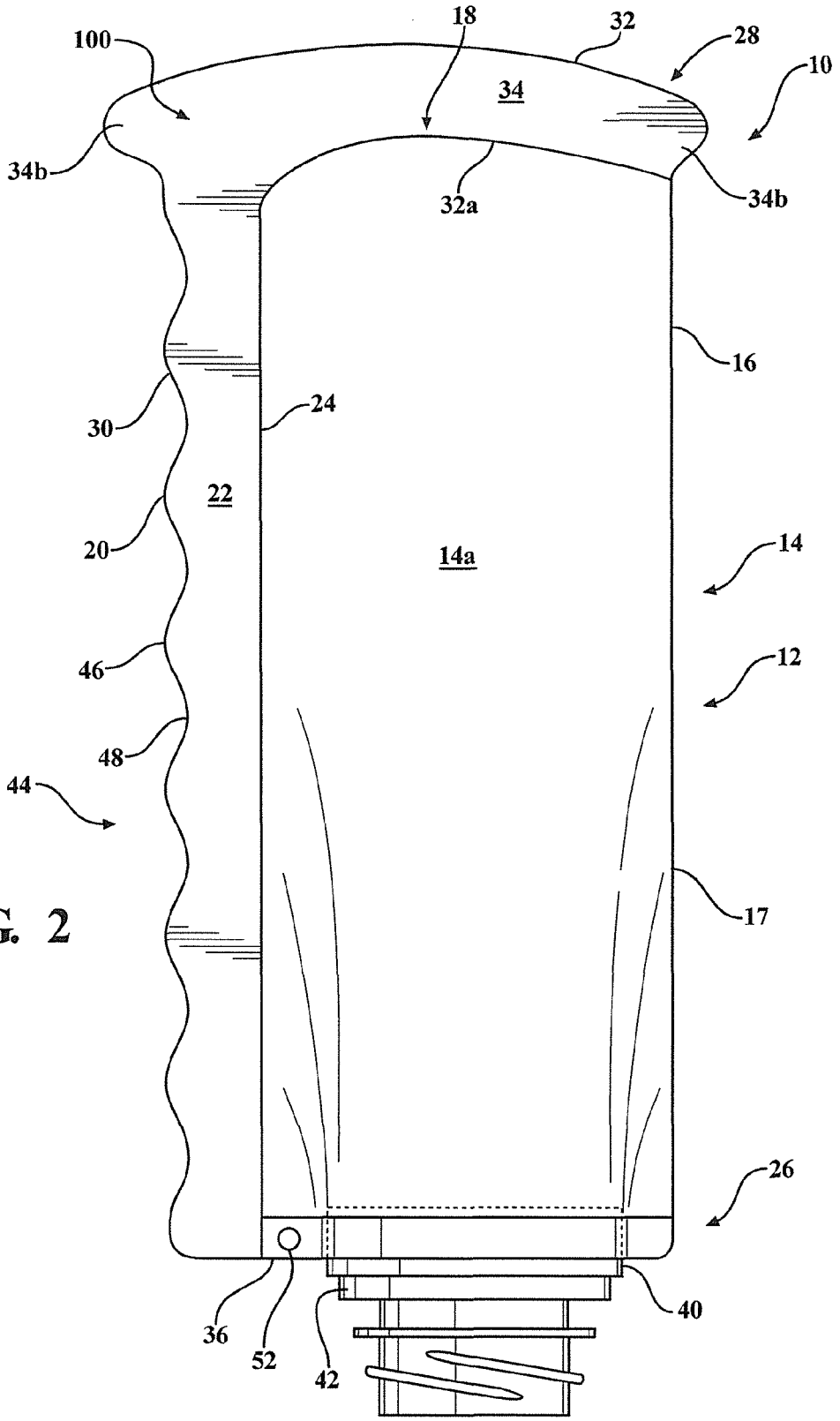
FIG. 2 is a perspective view of the front of a pouch body of the present invention prior to being filled.
Figure 3:
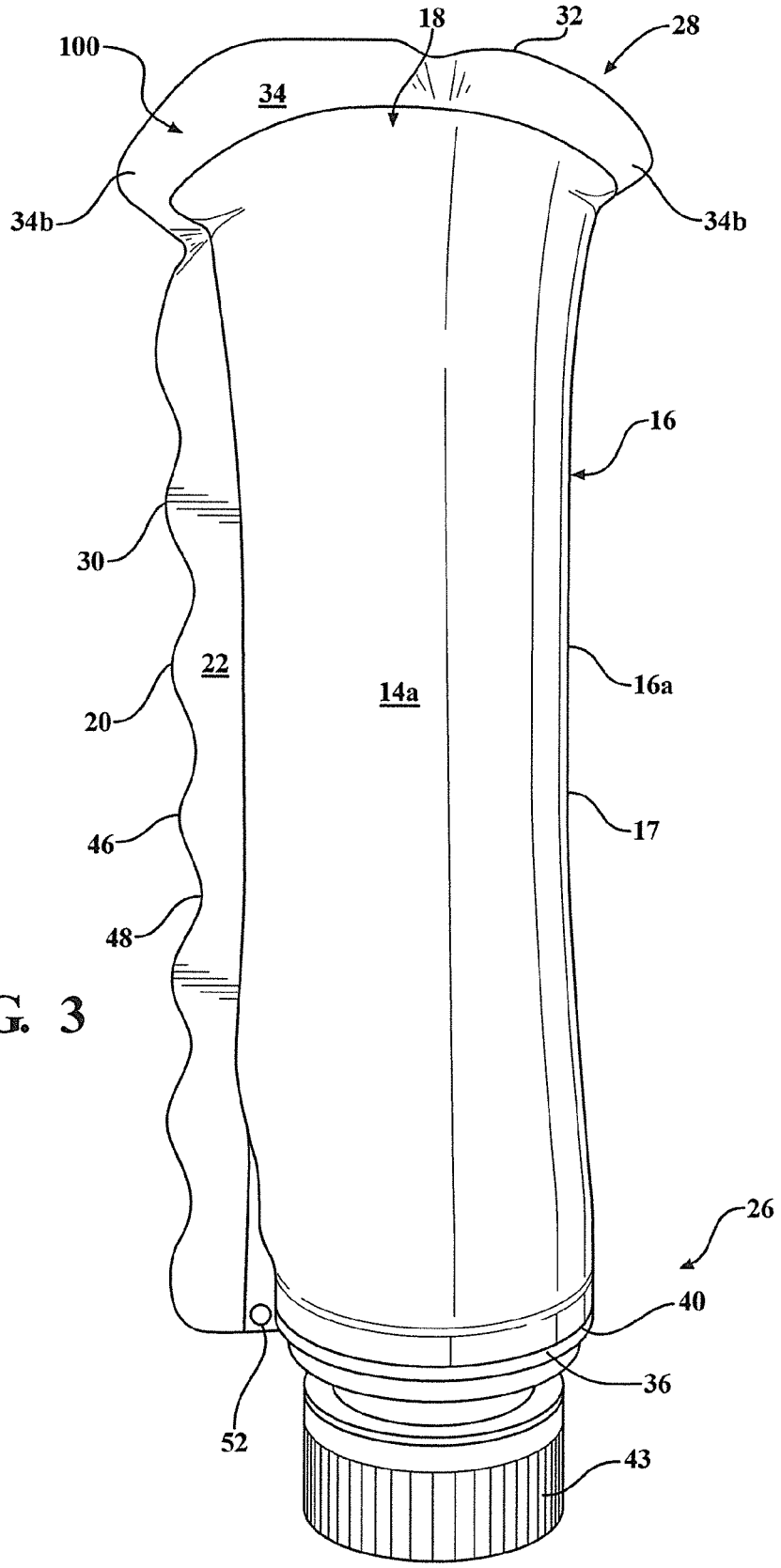
FIG. 3 is a perspective view of the pouch of FIG. 2 after being filled.

Referring to FIGS. 2 and 3, an illustration of a flexible pouch 10 of the present invention is provided. The flexible pouch 10 may be formed from a sheet of laminate material 100 cut so as to form a pouch sheet 12. The pouch sheet includes a first sheet portion 14 and a second sheet portion 16. The first and second sheet portions 14, 16 are folded onto each other to form a respective front **14*a* and back side 16*a* of a pouch body 18**.

The flexible pouch 10 is preferably formed from a roll (not shown) of preprinted material of extruded or laminate layers. The material is typically a three, or four, or five or more gauge material, or two laminations of material or the like. The outer layer is usually preprinted. Alternatively, at least a portion of the material may be not printed, i.e. translucent, in order to view the product contained therein. The clear portion could also be in a gusset or insert.

The choice of material is non-limiting, and includes material melts when exposed to a predetermined temperature. One example of a laminate material structure includes at least one layer of virgin polyethylene terphalate (PET), at least one layer of aluminum foil and another layer such as EVOH, PET, polyethylene or nylon or the like. Another type of laminate material structure may also include a metalized foil paper layer laminated to a cast polypropylene layer and another layer of PET, polyethylene or EVOH. There may be a fourth layer of nylon. Similarly, the laminate structure may include a cast polypropylene (CPP) layer, a polyethylene (PET) layer, a foil (AL) layer, a nylon (ONO) layer and another CPP layer. Another structure is the use of nylon, foil, nylon and cast polypropylene (ONO/AL/ONO/CPP) or CPP/NY/AL/CPP. Another example of a material structure is ONO/AL/COEX-ONO-LDPE. Still another is PET/AL/NYLON/CPP. The use of cast polypropylene laminate material also assists in retaining the filled shape of the container, even as the product is removed from the pouch 10. A further example of a laminate material structure is CPP/AL/ONO/PE.

The first sheet portion 14 may be folded onto the second sheet portion 16 along a fold 17 so as to form the pouch body 18. The first and second sheet portions each include an outer side edge 20. The outer side edge 20 extends along the side and between the top and bottoms of the respective first and second sheet portions 14, 16. The outer side edges 20 of respective first and second sheet portions 14, 16 are aligned to each other, pressed together and an outer side portion of the respective first and second sheet portions 14, 16 are sealed so as to enclose the pouch body 18, and form a peripheral side seal 22 having a predetermined width (W). The peripheral side seal 22 is planar and extends outwardly from the pouch body 18.

The peripheral side seal 22 has an inner seal edge 24 extending axially between the bottom 26 and top 28 of the pouch body 18. The peripheral side seal 22 further includes an outer seal edge 30 spaced apart the inner seal edge 24. The outer seal edge 30 defines the outer side edge 20 of the pouch body 18. The first and second sheet portions 14, 16 further include a top edge 32. The top edge 32 of the sheet 12 may also be sealed onto itself so as to form a top seal 34. The outer corners of the top edge 32 may be sealed along an arcuate path. The inner seal edge further includes top inner seal edge portion 32*a* spaced apart the top edge 32 of the top seal 34. The top inner seal edge portion 32*a* may also be arcuate so as to provide structural integrity to the pouch body 18. Specifically, fluid pressure is more evenly distributed along the top corners of the pouch relative to inner seal edges having a corner. Such a seal configuration facilitates a smooth and uniform appearance of the outer surface of the top portion of a filled pouch 10.

The first and second sheet portions 14, 16 further include a bottom edge 36. A portion of the bottom edge 36 is sealed onto itself so as to form a bottom seal 38 having an opening 40. A fitment 42 may be mounted to the opening 40 and sealed to the bottom edge 36 of the pouch body 18. Preferably, the fitment includes a flat top cover 43 (as seen in FIG. 3) configured to support the pouch body in an upright manner, as shown in FIG. 3. Any sealing technique currently known and used in the art is adaptable for use herein, illustratively including heat sealing, vibrational welding, thermoplastic welding, adhesives, and the like.

The peripheral side seal 22 may be cut so as to form a plurality of contours 44 extending axially along the side of the pouch body 18. The contours 44 are spaced apart from each other so as to form respective crests 46 and troughs 48 of a wave. More specifically, the crests 46 are spaced apart from each other so as to form a trough 48 configured to fittingly receive a finger. The crests 46 and troughs 48 are generally dimensioned the same as each other. Thus side of the pouch body 18 opposite the fold 17 has contours 44 which facilitate gripping and manipulating the pouch body 18.

Each outer side edge of the top seal 34 extend outwardly with respect to the mid-portion of the top seal 34 beyond the distal edges of the pouch body 18 as to form flared portion 34*b*. The flared portion 34*b* positioned on the same side as the contours 44 extend beyond the distal edge of the crests 46.

The contours 44 may be formed using a pair of opposing heating bars (not shown). The heating bars may include an outer peripheral edge having contours. The peripheral side seal 22 is placed between respective heating bars. The heating bars are heated to a predetermined temperature and pressed together. The free portion of the peripheral side seal 22 is then removed so as to leave a contoured edge 44. The peripheral side seal 22 may then be cooled so as to melt the edges together and seal the pouch body 18.

Figure 1:
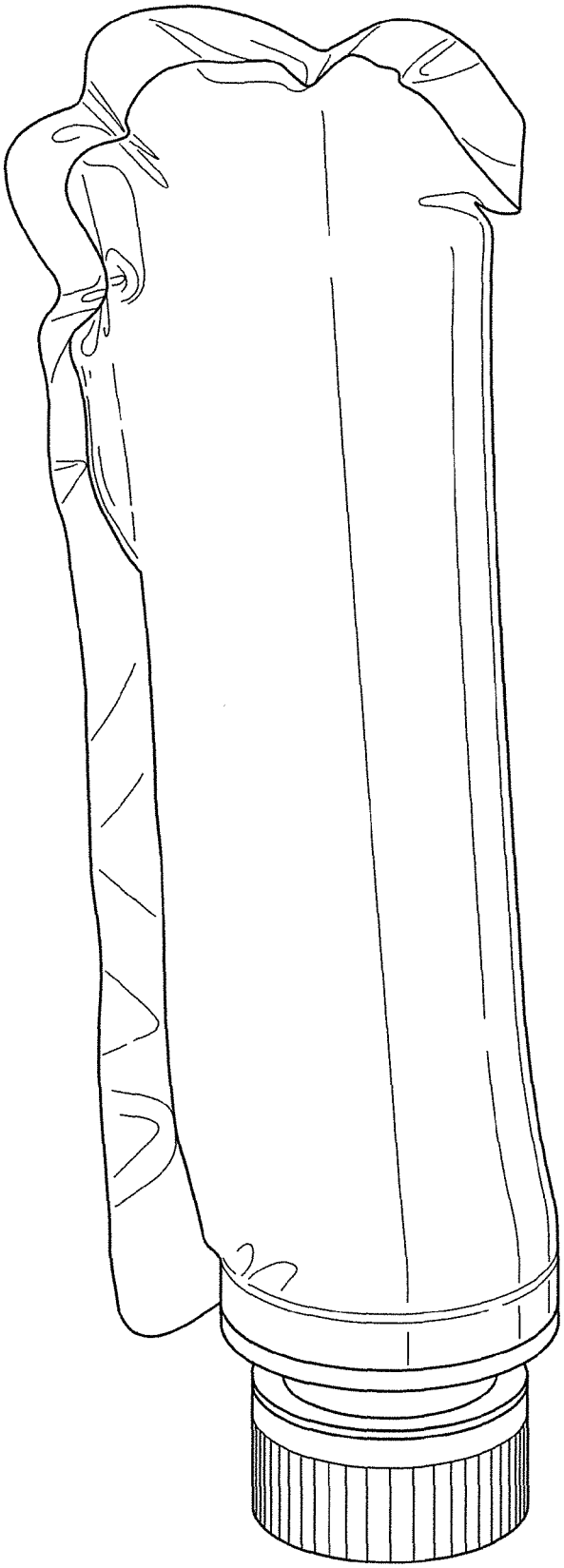
FIG. 1 PRIOR ART
FIG. 1 is a prior art view of a pouch body showing the deformations on the outer surface of the pouch body after filling operations.

The contoured edges 44 help maintain the inner seal edge 24 of the peripheral side seal 22. Thus the contoured edges 44 prevent the formation of wrinkles on the outer surface of the pouch body 18, along both the fold 17 and the peripheral side seal 22, as shown in FIG. 3 when compared to FIG. 1. Furthermore, the contours 44 reduce the effect of a straight edged pouch of the prior art by providing a support surface for individual fingers. Namely, the outer edge extending between respective crests 46 and troughs 48 provides grip support for fingers.

In a preferred embodiment, the pouch 10 further includes an aperture 52 disposed along the outer side edges 20 of the pouch body 18. For illustrative purposes, the aperture 52 is disposed along the bottom seal 38, but it is anticipated that the aperture 52 may be disposed on the peripheral side seal 22, or the top seal 34 as well. The aperture 52 is configured to engaged a hanging member (not shown) so as to suspend or retain the pouch 10 to a fixed structure or a user.

Figure 4:
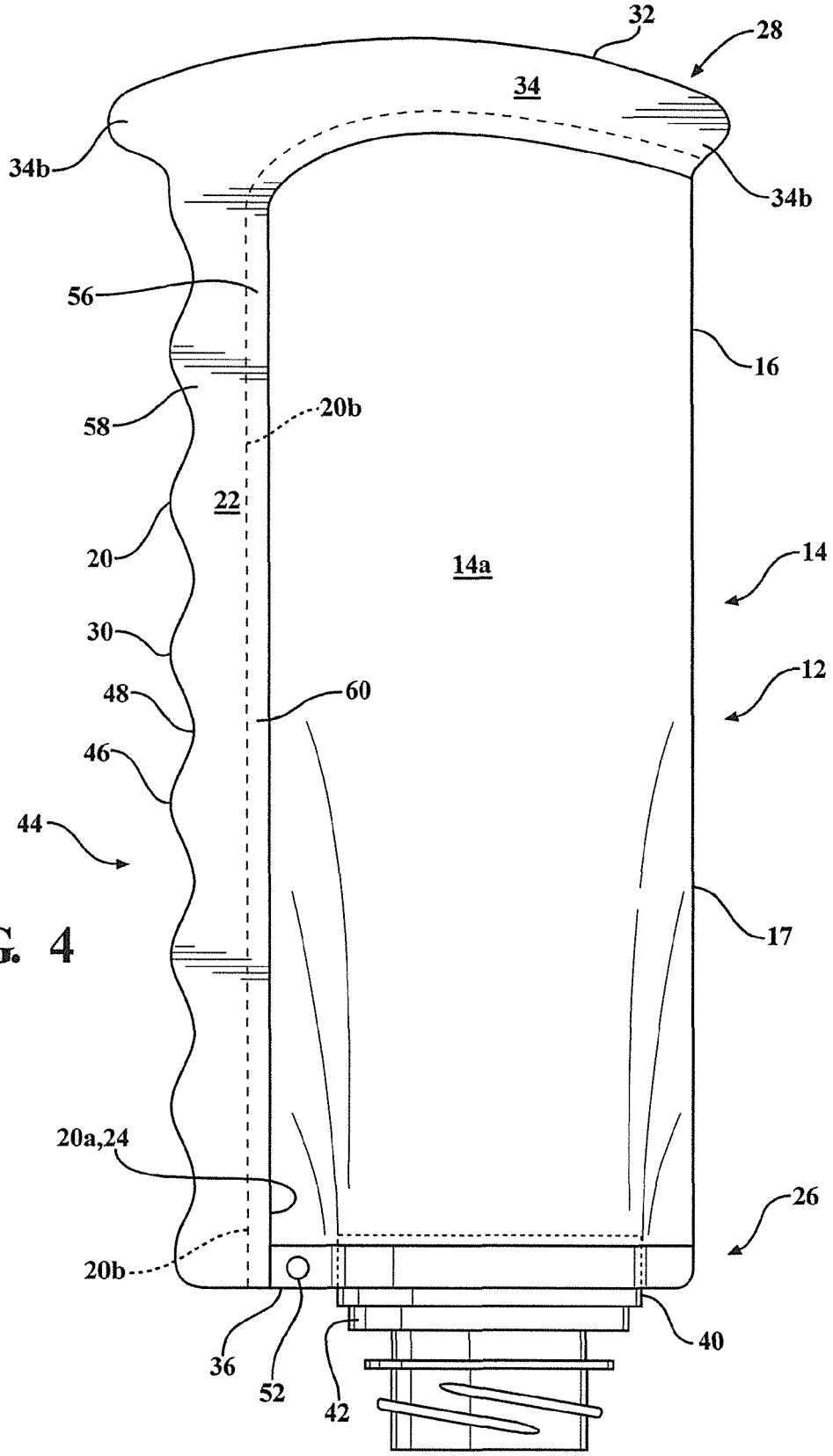
FIG. 4 is a perspective view of a pouch showing the different seals used to seal the side edges of the pouch.
Figure 5:
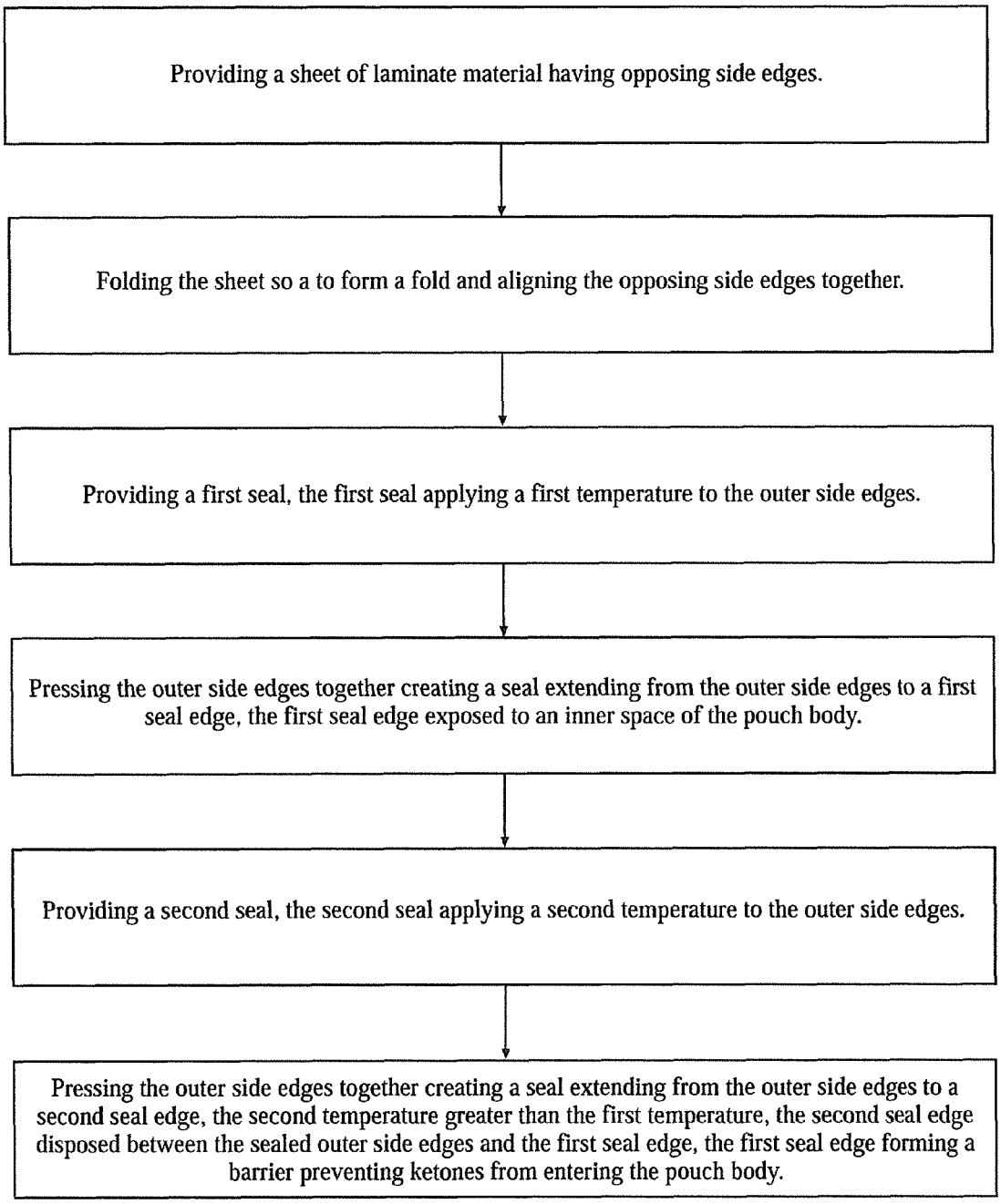
FIG. 5 is a diagram showing a method of forming a pouch.

With reference now to FIGS. 4 and 5, a method of forming a pouch is also provided herein. The flexible pouch 10 is preferably formed from a roll of preprinted material of extruded or laminate layers. The material is typically a three, or four, or five or more gauge material, or two laminations of material or the like. The outer layer is usually preprinted. Alternatively, at least a portion of the material may be not printed, i.e. translucent, in order to view the product contained therein. The clear portion could also be in a gusset or insert.

The choice of material is non-limiting, and includes material which may melt when exposed to a predetermined temperature. One example of a laminate material structure includes at least one layer of virgin polyethylene terphalate (PET), at least one layer of aluminum foil and another layer such as EVOH, PET, polyethylene or nylon or the like. Another type of laminate material structure may also include a metalized foil paper layer laminated to a cast polypropylene layer and another layer of PET, polyethylene or EVOH. There may be a fourth layer of nylon. Similarly, the laminate structure may include a cast polypropylene (CPP) layer, a polyethylene (PET) layer, a foil (AL) layer, a nylon (ONO) layer and another CPP layer. Another structure is the use of nylon, foil, nylon and cast polypropylene (ONO/AL/ONO/CPP) or CPP/NY/AL/CPP. Another example of a material structure is ONO/AL/COEX-ONO-LDPE. Still another is PET/AL/NYLON/CPP. The use of cast polypropylene laminate material also assists in retaining the filled shape of the container, even as the product is removed from the pouch 10. A further example of a laminate material structure is CPP/AL/ONO/PE.

The method includes the step of providing a first seal 56 to opposing side edges 20 of a sheet of laminate material to form a pouch body 18. The first seal 56 is configured to melt the outer surfaces of the respective side edges together to form what is commonly referenced in the art as a "Tack" seal. The first seal 56 may be formed using first heating bars (not shown). The first heating bars are configured to generate a first temperature to melt the surfaces of opposing side edge 20. It should be appreciated that the first temperature is not sufficient to melt the laminate material to the point where ketones are released. Further, only the respective inner surfaces of the side edges 20 are melted. The first heating bars press the melted side edges 20 pressed against each other so as to hold the opposing side edges 20 of the pouch in a fixed position with respect to each other. Thus, the melted side edges 20 form a tack seal sufficient to maintain the side edges in a fixed position with respect to each other. Further, the use of a first tack seal prevents the formation of ketones. The first seal extends from the outer side edge 20 of the pouch body to a first seal edge 20*a*. The first seal edge 20*a* extends axially along the length of the side of the pouch body and defines the inner edge 24 of the pouch body 18.

The method proceeds to applying a second seal 58, the second seal 58 is provided at a temperature greater than the first temperature. The second seal 58 is configured to melt the side edges together to form a unitary sheet of material. The second seal 58 may be formed using second heating bars (not shown). The second heating bars are configured to press and melt the opposing sides 20 of the pouch body together to form a unitary sheet of laminate material. The second seal extends from the outer side edge 20 of the pouch body to a second seal edge 20*b*. (indicated by the dashed lines) The second seal edge 20*b* is disposed between the first seal edge 20*a* and outer side edge 20, and extends axially between the top 26 and bottom 28 of the pouch body 18. Thus, the first seal 56 provides a barrier 60 preventing ketones from entering into the pouch body. The second seal 58 is configured to transform the melted edges into a solid and unitary piece. Thus, it is known that the second temperature must be higher, and during the process of transforming the side edges into a unitary piece, ketones are released. It should be appreciated that the first seal 56 and the second seal 58 may be applied to the top 26 of the pouch 10 as well, so as to form a bather blocking ketones.

The invention has been described in an illustrative manner. It is therefore to be understood that the terminology used is intended to be in the nature of words of description rather than limitation. Many modifications and variations of the invention are possible in light of the above teachings without varying from the scope and spirit of the invention described herein.

The invention claimed is:

1. A pouch for holding product, the pouch comprising:

a pouch body formed from a sheet of laminate material, the pouch body having a first side opposite a second side, and a bottom side opposite a top side, the bottom side having a fitment;

a fold extending generally along an axis defining the second side of the pouch body; and a peripheral side seal disposed along the first side, the peripheral side seal having a plurality of contours defining an outer side edge, the outer side edge spaced apart from an inner seal edge of the first and top sides of the pouch body so as to define a planar surface, the plurality of contours extending axially along the outer side edge of the pouch body, the contours including a plurality of crests and troughs arranged in a series, the crests spaced apart the troughs so as to form a space dimensioned to receive a finger so as to facilitate the gripping of the pouch body by a user, the peripheral side seal further disposed along the top side of the pouch body, so as to define a top seal portion, the top seal portion being planar and includes a pair of flared portions each of the pair of flared portions is disposed on each of the opposing sides of the top seal portion, one of the pair of flared portions extends outwardly beyond the fold of the pouch body and the other of the pair of flared portions is coplanar with the plurality of contours, wherein a distal edge of the other of the pair of flared portions extends outwardly beyond the distal edge of any one of the plurality of contours, wherein the pair of flared portions help prevent the formation of wrinkles along the first side of the pouch body.

2. The pouch as set forth in claim 1, wherein the crests are generally dimensioned the same as each other and wherein the troughs are generally dimensioned the same as each other.

* * * * *